US010801284B2

(12) United States Patent
Brown

(10) Patent No.: US 10,801,284 B2
(45) Date of Patent: Oct. 13, 2020

(54) EXPANDING AND COLLAPSING APPARATUS AND METHODS OF USE

(71) Applicants: PEAK WELL SYSTEMS PTY LTD, Bayswater (AU); PEAK WELL SYSTEMS LIMITED, Aberdeen (GB)

(72) Inventor: Gareth Edward George Brown, Ellon (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 167 days.

(21) Appl. No.: 16/066,044

(22) PCT Filed: Dec. 23, 2016

(86) PCT No.: PCT/GB2016/054064
§ 371 (c)(1),
(2) Date: Jun. 25, 2018

(87) PCT Pub. No.: WO2017/109508
PCT Pub. Date: Jun. 29, 2017

(65) Prior Publication Data

US 2019/0360288 A1 Nov. 28, 2019

(30) Foreign Application Priority Data

Dec. 23, 2015 (GB) ..... 1522725.9
Dec. 23, 2015 (GB) ..... 1522731.7

(51) Int. Cl.
*E21B 33/128* (2006.01)
*E21B 23/01* (2006.01)
(Continued)

(52) U.S. Cl.
CPC ..... *E21B 23/01* (2013.01); *E21B 19/10* (2013.01); *E21B 33/1216* (2013.01); *E21B 33/1293* (2013.01)

(58) Field of Classification Search
CPC .... E21B 23/01; E21B 29/005; E21B 33/1208; E21B 33/128; B23D 21/14; B26D 3/163
(Continued)

(56) References Cited

U.S. PATENT DOCUMENTS 9,043 A 6/1852 Wright
758,186 A 4/1904 Mabrey
(Continued)

FOREIGN PATENT DOCUMENTS

CH 295473 A 12/1953
DE 814546 A 9/1951
(Continued)

OTHER PUBLICATIONS

International Search and Written Opinion issued in the related PCT Application PCT/GB2016/054064, dated May 8, 2017 (11 pages).
(Continued)

*Primary Examiner* — Kenneth L Thompson
(74) *Attorney, Agent, or Firm* — Eileen Pape

(57) ABSTRACT

The invention provides an expanding and collapsing ring apparatus and method of use. The expanding and collapsing ring comprises a plurality of elements assembled together to form a ring structure oriented in a plane around a longitudinal axis. The ring structure defines an inner ring surface configured to be presented to a surface of an object arranged internally to the ring structure. The ring structure is operable to be moved between a collapsed condition and a first expanded condition by movement of the plurality of elements. The plurality of elements is operable to be moved between the expanded and collapsed conditions by sliding
(Continued)

with respect to one another in the plane of the ring structure. Applications of the invention include oilfield devices, connection systems, flow barriers and packers.

23 Claims, 7 Drawing Sheets

(51) Int. Cl.
*E21B 19/10* (2006.01)
*E21B 33/12* (2006.01)
*E21B 33/129* (2006.01)

(58) Field of Classification Search
USPC ..... 83/178
See application file for complete search history.

(56) References Cited

U.S. PATENT DOCUMENTS

| | | | | |
|---|---|---|---|---|
| 865,998 | A | 9/1907 | Cook | |
| 2,287,205 | A | 6/1942 | Stone | |
| 2,609,836 | A | 9/1952 | Knox | |
| 2,701,615 | A | 2/1955 | Riordan, Jr. | |
| 3,572,627 | A | 3/1971 | Jones | |
| 3,603,411 | A | 9/1971 | Link | |
| 3,915,424 | A | 10/1975 | LeRouax | |
| 4,460,150 | A | 7/1984 | Turlak et al. | |
| 4,842,082 | A | 6/1989 | Springer | |
| 5,341,888 | A | 8/1994 | Deschutter | |
| 5,507,465 | A * | 4/1996 | Borle | E21B 33/06 251/1.1 |
| 5,678,635 | A | 10/1997 | Dunlap et al. | |
| 5,685,078 | A | 11/1997 | Obst et al. | |
| 6,598,672 | B2 | 7/2003 | Bell et al. | |
| 7,290,603 | B2 | 11/2007 | Hiorth et al. | |
| 7,389,822 | B2 * | 6/2008 | Lohbeck | E21B 43/105 166/384 |
| 7,921,921 | B2 | 4/2011 | Bishop et al. | |
| 7,992,634 | B2 | 8/2011 | Angelle et al. | |
| 8,083,001 | B2 | 12/2011 | Conner et al. | |
| 8,167,033 | B2 | 5/2012 | White | |
| 8,459,344 | B1 | 6/2013 | Stone | |
| 8,555,980 | B1 | 10/2013 | Powell | |
| 8,733,453 | B2 | 5/2014 | Guerrero et al. | |
| 9,038,723 | B2 * | 5/2015 | Trudeau | B23D 21/14 166/298 |
| 9,051,812 | B2 * | 6/2015 | Clemens | E21B 23/01 |
| 9,806,566 | B2 | 10/2017 | Nagao et al. | |
| 10,258,361 | B2 | 4/2019 | Dickerson et al. | |
| 10,487,614 | B2 | 11/2019 | MacDonald | |
| 2007/0200299 | A1 * | 8/2007 | Kunz | F16J 15/125 277/511 |
| 2010/0071908 | A1 | 3/2010 | Bishop et al. | |
| 2011/0061857 | A1 | 3/2011 | White | |
| 2011/0127131 | A1 | 6/2011 | Simons et al. | |
| 2013/0112398 | A1 | 5/2013 | White | |
| 2013/0168076 | A1 | 7/2013 | Davis | |
| 2013/0269929 | A1 | 10/2013 | Smith | |
| 2013/0319654 | A1 | 12/2013 | Hiorth et al. | |
| 2014/0284047 | A1 * | 9/2014 | Lovslett | E21B 23/06 166/101 |
| 2015/0176361 | A1 * | 6/2015 | Prosser | E21B 34/14 166/192 |
| 2015/0275619 | A1 * | 10/2015 | Slup | E21B 33/1216 166/387 |
| 2016/0123100 | A1 | 5/2016 | Tse | |
| 2017/0370176 | A1 * | 12/2017 | Frazier | E21B 33/1212 |
| 2019/0264547 | A1 | 8/2019 | Cornelissen | |
| 2019/0352988 | A1 * | 11/2019 | Brown | E21B 23/01 |
| 2019/0352997 | A1 * | 11/2019 | Brown | E21B 33/134 |
| 2019/0360288 | A1 * | 11/2019 | Brown | E21B 33/1216 |
| 2019/0368274 | A1 * | 12/2019 | Brown | E21B 7/28 |

FOREIGN PATENT DOCUMENTS

| | | | |
|---|---|---|---|
| DE | 1775899 | A1 | 10/1971 |
| EP | 0533326 | A1 | 3/1993 |
| FR | 2996816 | A1 | 4/2014 |
| GB | 191010637 | A | 3/1911 |
| GB | 1452272 | A | 10/1976 |
| GB | 2127068 | A | 4/1984 |
| GB | 2488152 | A | 8/2012 |
| JP | S643330 | A1 | 1/1989 |
| JP | 2000120365 | A | 4/2000 |
| WO | 2017109506 | A2 | 6/2017 |
| WO | 2017109508 | A1 | 6/2017 |
| WO | 2017109509 | A1 | 6/2017 |
| WO | 2017109510 | A1 | 6/2017 |
| WO | 2017109511 | A1 | 6/2017 |

OTHER PUBLICATIONS

International Preliminary Report on Patentability issued in the related PCT Application PCT/GB2016/054064, dated Jun. 26, 2018 (7 pages).
Combined Search and Examination Report issued in the related GB Application 1622148.3, dated Jun. 21, 2017 (9 pages).
Examination Report issued in the related GB Application 1622148.3, dated Jul. 24, 2019 (4 pages).
International Search and Written Opinion issued in the related PCT Application PCT/GB2016/054065, dated May 8, 2017 (10 pages).
International Preliminary Report on Patentability issued in the related PCT Application PCT/GB2016/054065, dated Jun. 26, 2018 (6 pages).
Combined Search and Examination Report issued in the related GB Application 1622150.9, dated Mar. 31, 2017 (5 pages).
International Search and Written Opinion issued in the related PCT Application PCT/GB2016/054066, dated May 8, 2017 (9 pages).
International Preliminary Report on Patentability issued in the related PCT Application PCT/GB2016/054066, dated Jun. 26, 2018 (6 pages).
Combined Search and Examination Report issued in the related GB Application 1622151.9, dated Apr. 27, 2017 (5 pages).
Examination Report issued in the related GB Application 1622151.9, dated Jan. 24, 2019 (3 pages).
International Search and Written Opinion issued in the related PCT Application PCT/GB2016/054067, dated May 8, 2017 (11 pages).
International Preliminary Report on Patentability issued in the related PCT Application PCT/GB2016/054067, dated Jun. 26, 2018 (7 pages).
Combined Search and Examination Report issued in the related GB Application 1622152.5, dated Apr. 27, 2017 (7 pages).
International Search and Written Opinion issued in the related PCT Application PCT/GB2016/054058, dated Jun. 21, 2017 (12 pages).
International Preliminary Report on Patentability issued in the related PCT Application PCT/GB2016/054058, dated Jun. 26, 2018 (8 pages).
Combined Search and Examination Report issued in the related GB Application 1622147.5, dated Apr. 27, 2017 (7 pages).
Examination Report issued in the related GB Application 1622147.5, dated Jan. 31, 2019 (2 pages).
Office Action received in U.S. Appl. No. 16/066,038 dated Feb. 19, 2020, 19 pages.
Office Action received in U.S. Appl. No. 16/066,046 dated Mar. 2, 2020, 18 pages.
Office Action received in U.S. Appl. No. 16/066,049 dated Mar. 16, 2020, 15 pages.

* cited by examiner

EXPANDING AND COLLAPSING APPARATUS AND METHODS OF USE

This application is the U.S. National Stage of International Application No. PCT/GB2016/054064, filed Dec. 23, 2016. This application also claims the benefit of GB patent application No. 1522731.7, and GB patent application No. 1522725.9 both filed Dec. 23, 2015, the contents of which are hereby incorporated by reference in their entirety.

The present invention relates to an expanding and collapsing apparatus and methods of use, and in particular aspects, to an expanding apparatus in the form of a ring, operable to move between a collapsed condition and an expanded condition. The invention also relates to tools and devices incorporating the expansion apparatus and methods of use. Preferred embodiments of the invention relate to oilfield apparatus (including but not limited to downhole apparatus and wellhead apparatus) incorporating the apparatus and methods of use.

BACKGROUND TO THE INVENTION

In many fields of mechanical engineering, and in the field of hydrocarbon exploration and production in particular, it is known to provide expansion mechanisms for the physical interaction of tubular components. Expansion mechanisms may expand outwardly to engage an external surface, or may collapse inwardly to engage an internal surface.

Applications are many and varied, but those in hydrocarbon exploration and production include the actuation and setting of flow barriers and seal elements such as plugs and packers, anchoring and positioning tools such as wellbore anchors, casing and liner hangers, and locking mechanisms for setting equipment downhole. Other applications include providing mechanical support or back up for elements such as elastomers or inflatable bladders.

A typical anti-extrusion ring is positioned between a packer or seal element and its actuating slip members, and is formed from a split or segmented metallic ring. During deployment of the packer or seal element, the segments move to a radially expanded condition. During expansion and at the radially expanded condition, spaces are formed between the segments, as they are required to occupy a larger annular volume. These spaces create extrusion gaps, which may result in failure of the packer or seal under working conditions.

Various configurations have been proposed to minimise the effect of spaces between anti-extrusion segments, including providing multi-layered rings, such that extrusion gaps are blocked by an offset arrangement of segments. For example, U.S. Pat. No. 6,598,672 describes an anti-extrusion rings for a packer assembly which has first and second ring portions which are circumferentially offset to create gaps in circumferentially offset locations.

U.S. Pat. No. 2,701,615 discloses a well packer comprising an arrangement of crowned spring metal elements which are expanded by relative movement.

Other proposals, for example those disclosed in U.S. Pat. Nos. 3,572,627, 7,921,921, US 2013/0319654, U.S. Pat. Nos. 7,290,603 and 8,167,033 include arrangements of circumferentially lapped segments. U.S. Pat. No. 3,915,424 describes a similar arrangement in a drilling BOP configuration, in which overlapping anti-extrusion members are actuated by a radial force to move radially and circumferentially to a collapsed position which supports annular sealing elements. Such arrangements avoid introducing extrusion gaps during expansion, but create a ring with uneven or stepped faces or flanks. These configurations do not provide an unbroken support wall for a sealing element, are spatially inefficient, and may be difficult to reliably move back to their collapsed configurations.

U.S. Pat. No. 8,083,001 proposes an alternative configuration in which two sets of wedge shaped segments are brought together by sliding axially with respect to one another to create an expanded gauge ring.

In anchoring, positioning, setting, locking and connection applications, radially expanding and collapsing structures are typically circumferentially distributed at discrete locations when at their increased outer diameter. This reduces the surface area available to contact an auxiliary engagement surface, and therefore limits the maximum force and pressure rating for a given size of device.

SUMMARY OF THE INVENTION

It is amongst the claims and objects of the invention to provide an expanding and collapsing apparatus and methods of use which obviate or mitigate disadvantages of previously proposed expanding and collapsing apparatus.

It is amongst the aims and objects of the invention to provide an oilfield apparatus, including, but not limited to, a downhole apparatus or a wellhead apparatus, incorporating an expanding and collapsing apparatus, which obviates or mitigates disadvantages of prior art oilfield apparatus.

Further aims and objects of the invention will be apparent from reading the following description.

According to a first aspect of the invention, there is provided an apparatus comprising: a plurality of elements assembled together to form a ring structure oriented in a plane around a longitudinal axis;

wherein the ring structure defines an inner ring surface configured to be presented to a surface of an object arranged internally to the ring structure;

wherein the ring structure is operable to be moved between an expanded condition and a collapsed condition by movement of the plurality of elements on actuation by an axial force;

and wherein the plurality of elements is operable to be moved between the expanded and collapsed conditions by sliding with respect to one another in the plane of the ring structure.

The object may be an auxiliary object configured to extend through the ring structure.

The collapsed condition may be a first condition of the apparatus, and the expanded condition may be a second condition of the apparatus. Thus the apparatus may be normally collapsed, and may be actuated to be expanded. Alternatively, the expanded condition may be a first condition of the apparatus, and the collapsed condition may be a second condition of the apparatus. Thus the apparatus may be normally expanded, and may be actuated to be collapsed.

The plane of the ring structure may be perpendicular to the longitudinal axis. The ring structure, and its plane of orientation, may be operable to move on the apparatus during expansion and/or collapsing. The movement of the plane may be an axial sliding movement, during expanding and/or collapsing of the ring structure.

The ring structure may include one or more ring surfaces which is parallel to the longitudinal axis of the apparatus. Alternatively, or in addition, the ring structure may include one or more ring surfaces which is perpendicular to the longitudinal axis of the apparatus, and/or a surface which is inclined to the longitudinal axis of the apparatus.

Alternatively, the inner ring surface may be a substantially cylindrical surface. The ring surface may be arranged to contact or otherwise interact with an outer surface of a tubular or cylinder.

The ring surface may be substantially smooth. Alternatively, the ring surface may be profiled, and/or may provided with one or more functional formations thereon, for interacting with the surface of an object arranged.

In the collapsed condition, the elements may be arranged generally at collapsed radial positions, and may define a collapsed outer diameter and inner diameter of the ring structure.

In the expanded condition, the elements may be arranged generally at expanded radial positions, and may define an expanded outer diameter and inner diameter of the ring structure. The ring surface may be located at or on the collapsed inner diameter of the ring structure.

In the collapsed condition, the elements may occupy a collapsed annular volume, and in the expanded condition the elements may occupy an expanded annular volume. The collapsed annular volume and the expanded annular volume may be discrete and separated volumes, or the volumes may partially overlap.

The elements may be configured to move between their expanded and collapsed radial positions in a path which is tangential to a circle described around and concentric with the longitudinal axis.

Preferably, each element of the ring structure comprises a first contact surface and second contact surface respectively in abutment with first and second adjacent elements. The elements may be configured to slide relative to one another along their respective contact surfaces.

The first contact surface and/or the second contact surface may be oriented tangentially to a circle described around and concentric with the longitudinal axis. The first contact surface and the second contact surface are preferably non-parallel. The first contact surface and the second contact surface may converge towards one another in a direction towards an inner surface of the ring structure (and may therefore diverge away from one another in a direction away from an inner surface of the ring structure).

At least some of the elements are preferably provided with interlocking profiles for interlocking with an adjacent element. Preferably the interlocking profiles are formed in the first and/or second contact surfaces. Preferably, an element is configured to interlock with a contact surface of an adjacent element. Such interlocking may prevent or restrict separation of assembled adjacent elements in a circumferential and/or radial direction of the ring structure, while enabling relative sliding movement of adjacent elements.

Preferably, at least some of, and more preferably all of, the elements assembled to form a ring are identical to one another, and each comprises an interlocking profile which is configured to interlock with a corresponding interlocking profile on another element. The interlocking profiles may comprise at least one recess such as groove, and at least one protrusion, such as a tongue or a pin, configured to be received in the groove. The interlocking profiles may comprise at least one dovetail recess and dovetail protrusion.

The first and second contact surfaces of an element may be oriented on first and second planes, which may intersect an inner surface of the ring at first and second intersection lines, such that a sector of an imaginary cylinder is defined between the longitudinal axis and the intersection lines. The central angle of the sector may be 45 degrees or less. Such a configuration corresponds to eight or more elements assembled together to form the ring structure.

Preferably, the central angle of the sector is 30 degrees or less, corresponding to twelve or more elements assembled together to form the ring. More preferably, the central angle of the sector is in the range of 10 degrees to 20 degrees, corresponding to eighteen to thirty-six elements assembled together to form the ring. In a particular preferred embodiment, the central angle of the sector is 15 degrees, corresponding to twenty-four elements assembled together to form the ring structure.

Preferably, an angle described between the first contact and second contact surfaces corresponds to the central angle of the sector. Preferably therefore, an angle described between the first contact and second contact surfaces is in the range of 10 degrees to 20 degrees, and in a particular preferred embodiment, the angle described between the first contact and second contact surfaces is 15 degrees, corresponding to twenty-four elements assembled together to form the ring structure.

In a preferred embodiment, the apparatus comprises a support surface for the ring structure. The support surface may be the inner surface of a mandrel or tubular. The support surface may support the ring structure in an expanded condition of the apparatus.

In some embodiments, the apparatus is operated in its expanded condition, and in other embodiments, the apparatus is operated in its collapsed condition. Preferably, elements forming the ring structure are mutually supportive in an operating condition of the apparatus. Where the operating condition of the apparatus its collapsed condition (i.e. when the apparatus is operated in its collapsed condition), the ring structure is preferably a substantially solid ring structure in its collapsed condition, and the elements may be fully mutually supported.

The apparatus may comprise a formation configured to impart a radial expanding or collapsing force component to the elements of a ring structure from an axial actuation force. The apparatus may comprise a pair of formations configured to impart a radial expanding or collapsing force component to the elements of a ring structure from an axial actuation force. The formation (or formations) may comprise a wedge or wedge profile, and may comprise a cone wedge or wedge profile. The cone wedge or wedge profile may be inverted, such that the wedge surface defines an inner surface of a part of a cone.

The apparatus may comprise a biasing means, which may be configured to bias the ring structure to one of its expanded or collapsed conditions. The biasing means may comprise a circumferential spring, a garter spring, or a spiral retaining ring. The biasing means may be arranged around an outer surface of a ring structure, to bias it towards a collapsed condition, or may be arranged around an inner surface of a ring structure, to bias it towards an expanded condition. One or more elements may comprise a formation such as a groove for receiving the biasing means. Preferably, grooves in the elements combine to form a circumferential groove in the ring structure. Multiple biasing means may be provided on the ring structure.

According to a second aspect of the invention, there is provided an expanding and collapsing ring apparatus comprising:

a plurality of elements assembled together to form a ring structure oriented in a plane around a longitudinal axis;

wherein the ring structure defines an inner ring surface configured to be presented to a surface of an object arranged internally to the ring structure;

wherein the ring structure is operable to be moved between an expanded condition and a collapsed condition by movement of the plurality of elements on actuation by an axial force;

and wherein each of the plurality of elements is operable to be moved between the expanded and collapsed conditions by sliding with respect to an adjacent pair of elements.

Embodiments of the second aspect of the invention may include one or more features of the first aspect of the invention or its embodiments, or vice versa.

According to a third aspect of the invention, there is provided an expanding and collapsing ring apparatus comprising:

a plurality of elements assembled together to form a ring structure oriented in a plane around a longitudinal axis;

wherein the ring structure defines an inner ring surface configured to be presented to a surface of an object arranged internally to the ring structure;

wherein the ring structure is operable to be moved between an expanded condition and a collapsed condition by movement of the plurality of elements on actuation by an axial force;

wherein the plurality of elements is operable to be moved between the expanded and collapsed conditions by sliding relative to one another in directions tangential to a circle concentric with the ring structure.

Embodiments of the third aspect of the invention may include one or more features of the first or second aspects of the invention or their embodiments, or vice versa.

According to a fourth aspect of the invention, there is provided an expanding and collapsing ring apparatus comprising:

a plurality of elements assembled together to form a ring structure oriented in a plane around a longitudinal axis;

wherein the ring structure defines an inner ring surface configured to be presented to a surface of an object arranged internally to the ring structure;

wherein the ring structure is operable to be moved between an expanded condition and a collapsed condition by movement of the plurality of elements on actuation by an axial force;

wherein in the collapsed condition, the plurality of elements combine to form a solid ring structure having a substantially smooth circular inner surface.

The substantially smooth inner surface may comprise a smooth circular profile in a plane parallel to the plane of the ring structure. The substantially smooth inner surface may be substantially unbroken. Preferably, the substantially smooth inner surface comprises one or more smooth side surfaces. The smooth outer surface may comprise a smooth radially extending surface, and may comprise a first side of an inward annular projection defined by the ring structure in its collapsed condition. The smooth surface may comprise a first side and an opposing second side of an inward annular projection defined by the ring structure in its collapsed condition. Thus one or more flanks or faces of the ring structure, which are the surfaces presented in the longitudinal direction, may have smooth surfaces.

Preferably, the plurality of elements is operable to be moved between the expanded and collapsed conditions in the plane of the ring structure. The plurality of elements may be operable to be moved between the expanded and collapsed conditions by sliding with respect to an adjacent pair of elements. Sliding may be in a direction tangential to a circle concentric with the ring structure.

Embodiments of the fourth aspect of the invention may include one or more features of the first to third aspects of the invention or their embodiments, or vice versa.

According to a fifth aspect of the invention, there is provided an oilfield tool comprising the apparatus of any of the first to fourth aspects of the invention.

The oilfield tool may be a downhole tool. Alternatively, the oilfield tool may comprise a wellhead tool.

According to a sixth aspect of the invention, there is provided an annular blowout preventer apparatus comprising:

a housing defining a throughbore, the throughbore configured for the passage of drilling equipment therethrough;

a plurality of elements assembled together to form a ring structure oriented in a plane around the longitudinal axis of the throughbore;

wherein the ring structure defines an inner ring surface configured to be presented to a surface of an object arranged internally to the ring structure in the throughbore;

wherein the ring structure is operable to be moved between an expanded condition and a collapsed condition by movement of the plurality of elements on actuation by an axial force;

wherein in the collapsed condition, the ring structure presents the inner surface to an object in the throughbore;

and wherein the plurality of elements is operable to be moved between the expanded and collapsed conditions by sliding with respect to one another in the plane of the ring structure.

Preferably, the apparatus comprises a piston assembly, configured to move axially in the housing to impart an axial force to the ring structure.

Preferably the piston assembly is hydraulically actuated to move between expanded and collapsed conditions.

The apparatus may be configured to create a fluid barrier in an annular space between the housing and an object in the throughbore. The apparatus may be configured to create a fluid seal in an annular space between the housing and an object in the throughbore.

The fluid barrier and/or may be created by the presentation of the inner surface of the ring structure to the object in the throughbore. Alternatively, or in addition, the apparatus may comprise a separate seal element, which may be supported or backed-up by the ring structure. The ring structure may provide an anti-extrusion ring for a separate seal element.

The inner surface of the ring structure may be defined by the inner surfaces of the plurality of elements. The inner surfaces of the plurality of elements may be configured to be presented directly against the object in the throughbore. Alternatively, or in addition, the apparatus may comprise an intermediate structure or material disposed between the inner surfaces of the elements and the object in the throughbore.

In one embodiment, the elements of the ring structure are configured to conform, deform or compress in a collapsed condition to form a fluid barrier or seal with an object in the throughbore. The elements may be formed, at least partially, from a compressible and/or resilient material, such as an elastomer, rubber or polymer.

Alternatively, or in addition, the elements may be formed, at least partially, from a metal or metal alloy, and may be coated or covered with a compressible and/or resilient material, such as an elastomer, rubber or polymer.

Embodiments of the sixth aspect of the invention may include one or more features of the first to fourth aspects of the invention or their embodiments, or vice versa.

According to a seventh aspect of the invention, there is provided a connection system comprising a first connector and a second connector, wherein one of the first and second connectors comprises the apparatus of any of the first to fourth aspects of the invention.

Embodiments of the seventh aspect of the invention may include one or more features of the first to fourth aspects of the invention or their embodiments, or vice versa.

According to an eighth aspect of the invention, there is provided a method of expanding an apparatus, the method comprising:

providing an apparatus comprising a plurality of elements assembled together to form a ring structure oriented in a plane around a longitudinal axis;

imparting or releasing an axial force to the ring structure to move the plurality of elements by sliding with respect to one another in the plane of the ring structure, thereby moving the ring structure from a collapsed condition to an expanded condition.

Embodiments of the eighth aspect of the invention may include one or more features of the first to fourth aspects of the invention or their embodiments, or vice versa.

According to a ninth aspect of the invention, there is provided a method of collapsing an apparatus, the method comprising:

providing an apparatus comprising a plurality of elements assembled together to form a ring structure oriented in a plane around a longitudinal axis;

imparting or releasing an axial force to the ring structure to move the plurality of elements by sliding with respect to one another in the plane of the ring structure, thereby moving the ring structure from an expanded condition to a collapsed condition.

Embodiments of the ninth aspect of the invention may include one or more features of the first to fourth aspects of the invention or their embodiments, or vice versa.

According to a further aspect of the invention, there is provided an apparatus comprising:

a plurality of elements assembled together to form a ring structure oriented in a plane around a longitudinal axis;

wherein the ring structure defines an inner ring surface configured to be presented to a surface of an object arranged internally to the ring structure;

wherein the ring structure is operable to be moved between an expanded condition and a collapsed condition by movement of the plurality of elements;

and wherein the plurality of elements is operable to be moved between the expanded and collapsed conditions by sliding with respect to one another in the plane of the ring structure.

According to a further aspect of the invention, there is provided an expanding and collapsing ring apparatus comprising:

a plurality of elements assembled together to form a ring structure oriented in a plane around a longitudinal axis;

wherein the ring structure defines an inner ring surface configured to be presented to a surface of an object arranged internally to the ring structure;

wherein the ring structure is operable to be moved between an expanded condition and a collapsed condition by movement of the plurality of elements;

and wherein each of the plurality of elements is operable to be moved between the expanded and collapsed conditions by sliding with respect to an adjacent pair of elements.

According to a further aspect of the invention, there is provided an expanding and collapsing ring apparatus comprising:

a plurality of elements assembled together to form a ring structure oriented in a plane around a longitudinal axis;

wherein the ring structure defines an inner ring surface configured to be presented to a surface of an object arranged internally to the ring structure;

wherein the ring structure is operable to be moved between an expanded condition and a collapsed condition by movement of the plurality of elements;

wherein the plurality of elements is operable to be moved between the expanded and collapsed conditions by sliding relative to one another in directions tangential to a circle concentric with the ring structure.

According to a further aspect of the invention, there is provided an expanding and collapsing ring apparatus comprising:

a plurality of elements assembled together to form a ring structure oriented in a plane around a longitudinal axis;

wherein the ring structure defines an inner ring surface configured to be presented to a surface of an object arranged internally to the ring structure;

wherein the ring structure is operable to be moved between an expanded condition and a collapsed condition by movement of the plurality of elements on actuation by an axial force;

wherein in the expanded condition, the plurality of elements combine to form a solid ring structure having a substantially smooth circular inner surface.

According to a further aspect of the invention, there is provided an expanding and collapsing ring apparatus comprising:

a plurality of elements assembled together to form a ring structure oriented in a plane around a longitudinal axis;

wherein the ring structure defines an inner ring surface configured to be presented to a surface of an object arranged internally to the ring structure;

wherein the ring structure is operable to be moved between an expanded condition and a collapsed condition by movement of the plurality of elements;

wherein in the collapsed condition, the plurality of elements combine to form a solid ring structure having a substantially smooth circular inner surface.

According to a further aspect of the invention, there is provided an annular blowout preventer apparatus comprising:

a housing defining a throughbore, the throughbore configured for the passage of drilling equipment therethrough;

a plurality of elements assembled together to form a ring structure oriented in a plane around the longitudinal axis of the throughbore;

wherein the ring structure defines an inner ring surface configured to be presented to a surface of an object arranged internally to the ring structure in the throughbore;

wherein the ring structure is operable to be moved between an expanded condition and a collapsed condition by movement of the plurality of elements;

wherein in the collapsed condition, the ring structure presents the inner surface to an object in the throughbore;

and wherein the plurality of elements is operable to be moved between the expanded and collapsed conditions by sliding with respect to one another in the plane of the ring structure.

According to a further aspect of the invention, there is provided a method of expanding an apparatus, the method comprising:

providing an apparatus comprising a plurality of elements assembled together to form a ring structure oriented in a plane around a longitudinal axis;

imparting or releasing a force to the ring structure to move the plurality of elements by sliding with respect to one another in the plane of the ring structure, thereby moving the ring structure from a collapsed condition to an expanded condition.

Embodiments of the eighth aspect of the invention may include one or more features of the first to fourth aspects of the invention or their embodiments, or vice versa.

According to a further aspect of the invention, there is provided a method of collapsing an apparatus, the method comprising:

providing an apparatus comprising a plurality of elements assembled together to form a ring structure oriented in a plane around a longitudinal axis;

imparting or releasing a force to the ring structure to move the plurality of elements by sliding with respect to one another in the plane of the ring structure, thereby moving the ring structure from an expanded condition to a collapsed condition.

According to a further aspect of the invention, there is provided fluid conduit tool comprising the apparatus according to any previous aspect of the invention. The fluid conduit tool may be configured for use in pipelines or other fluid conduits, which may be surface fluid conduits or subsea fluid conduits, and may be oilfield non-oilfield fluid conduits.

Embodiments of the further aspects of the invention may include one or more features of the first to ninth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1A:
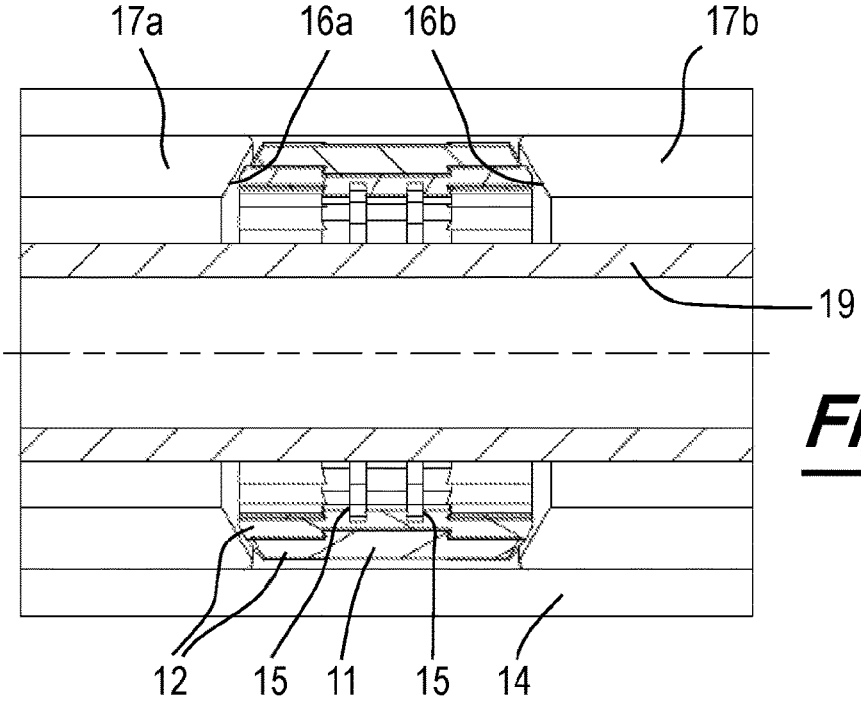
FIGS. 1A to 1C are respectively longitudinal sectional, isometric sectional and end views of an apparatus according to a first embodiment of the invention, shown in an expanded condition.

Referring firstly to FIGS. 1 to 4, the principles of the invention will be described with reference to a collapsing apparatus in accordance with a first embodiment. In this embodiment, the collapsing apparatus, generally depicted at 10, comprises a collapsing ring structure configured to be collapsed from a first expanded condition (shown in FIGS. 1A to 1C) to a second collapsed condition (shown in FIGS. 2A to 2C). The apparatus of this and other embodiments may be referred to as a "collapsing apparatus" for convenience, as it is operable to move to a collapsed state from a normal expanded state. However, the apparatus may equally be referred to as an expanding apparatus, or an expanding or collapsing apparatus, as it is capable of being expanded or collapsed depending on operational state.

The collapsing apparatus 10 comprises a plurality of elements 12 assembled together to form a ring structure 11. The elements 12 define an outer ring surface 13 which is in contact with the inner surface of cylinder 14. Each element 12 comprises an inner surface 20, an outer surface 21 and first and second contact surfaces 22, 23. The first and second contact surfaces are oriented in non-parallel planes, which are tangential to a circle centred on the longitudinal axis of the apparatus. The planes converge towards the inner surface of the element. Therefore, each element is in the general form of a wedge, and the wedges are assembled together in a circumferentially overlapping fashion to form the ring structure 11. In use, the first and second contact surfaces of adjacent elements are mutually supportive. FIGS. 1A to 2C show the ring structure in contact with an outside surface of an internal tubular 19.

Figure 3A:
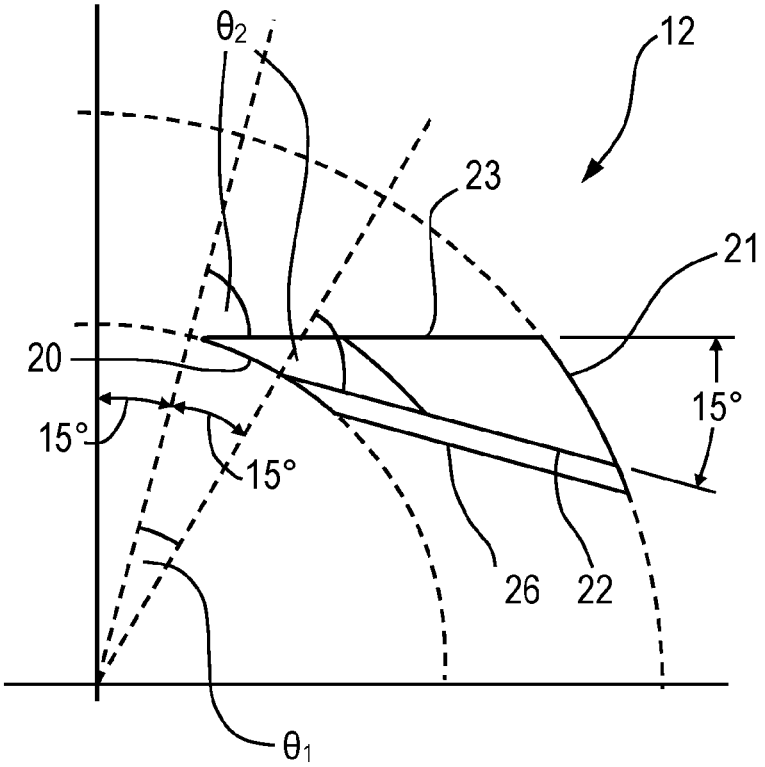
FIGS. 3A and 3B are geometric representations of an element of the apparatus of FIGS. 1A to 1C, shown from one side.
Figure 3B:
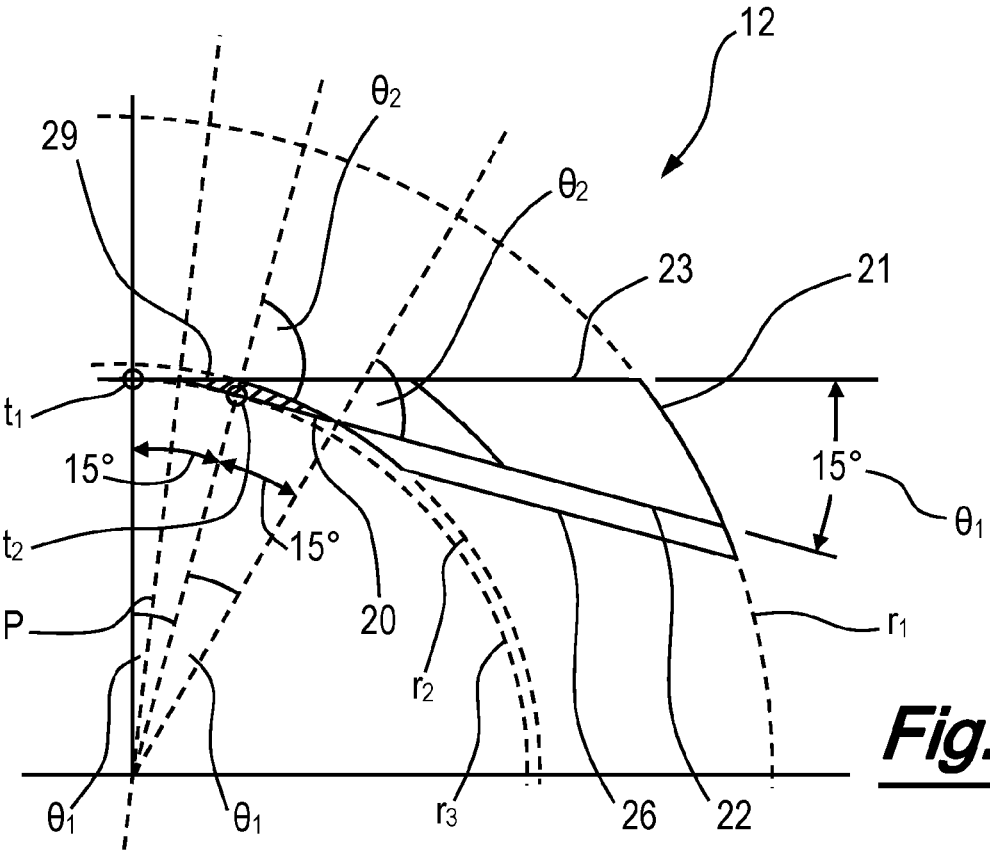
Figure 4A:
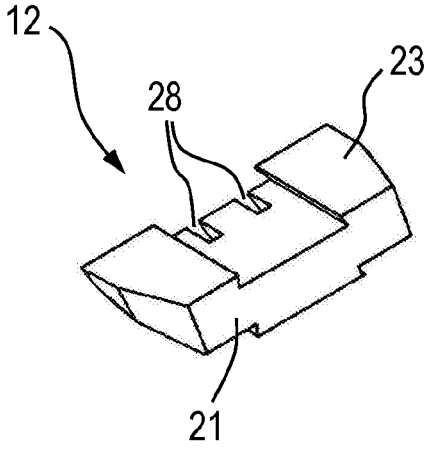
FIGS. 4A to 4F are respectively first perspectives, second perspective, plan, first end, lower and second end views of an element of the apparatus of FIGS. 1A to 1C.
Figure 4B:
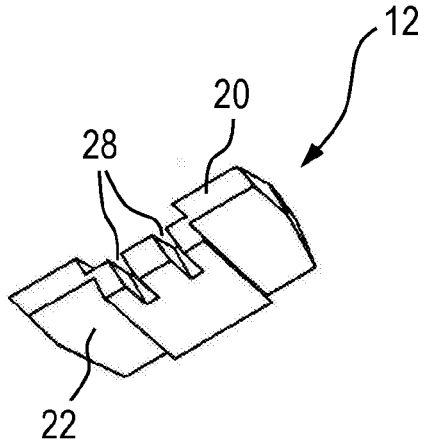
Figure 4C:
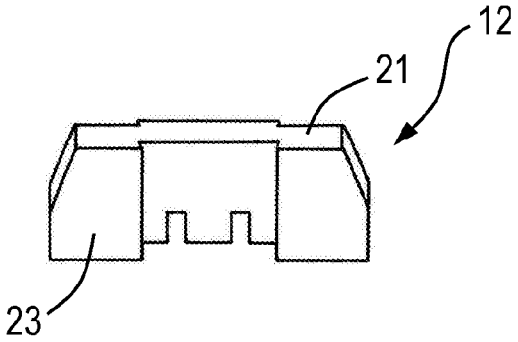
Figure 4D:
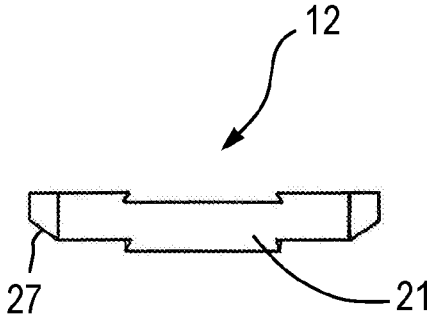
Figure 4E:
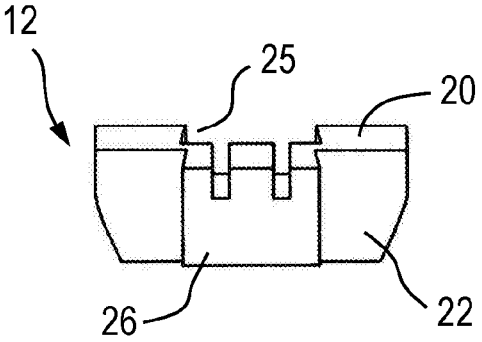
Figure 4F:
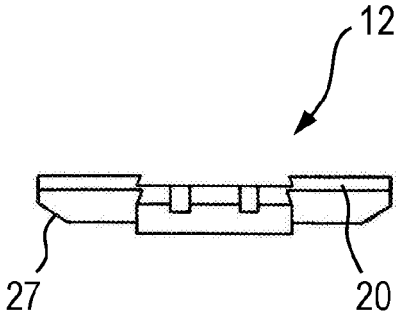

As most clearly shown in FIGS. 3A and 3B, when the ring structure is collapsed to its optimal inner diameter, the orientation planes of the first and second contact surfaces 22, 23 intersect an inner surface of the ring structure, and together with the longitudinal axis of the apparatus, the lines of intersection define a sector of a cylinder. In this case, the ring structure is formed from twenty-four identical elements, and the central angle is 15 degrees. The angle described between the orientation planes of the first and second contact surface is the same as the central angle of the cylindrical sector, so that the elements are arranged rotationally symmetrically in the structure.

As shown in FIG. 3B, each element is based on a notional wedge-shaped segment of a ring centred on an axis, with each notional wedge-shaped segment being inclined with respect to the radial direction of the ring. The nominal outer diameter of the segment is at the optimum expansion condition of the ring (with radius shown at $r_1$).

The orientation planes of the first and second contact surfaces of the element are tangential to a circle with radius $r_3$ concentric with the ring at points $t_1$, $t_2$. The angle described between the tangent points is equal to the angle $\theta_1$ of the segment. The orientation planes of the first and second contact surfaces of each notional wedge-shaped segment intersect one another on a radial plane P which bisects radial planes located at the tangent points (i.e. is at an angle of $\theta_1/2$ to both). This intersection plane P defines the expanding and collapsing path of the segment.

Figure 1C:
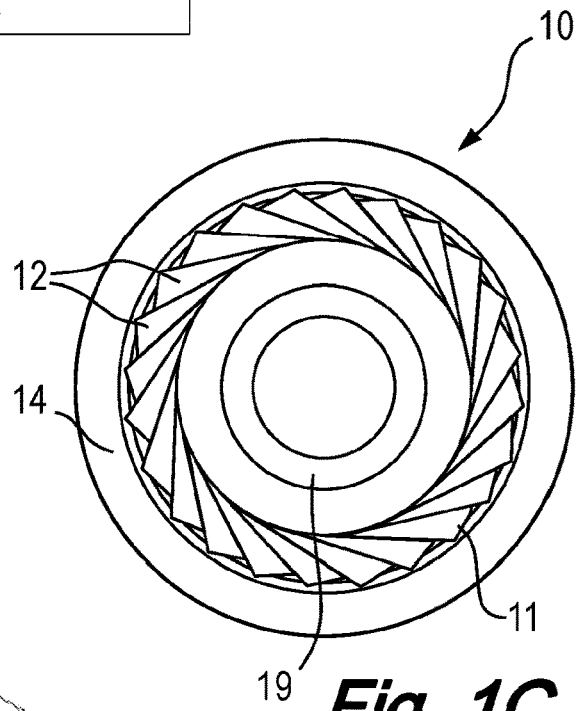
Figure 1B:
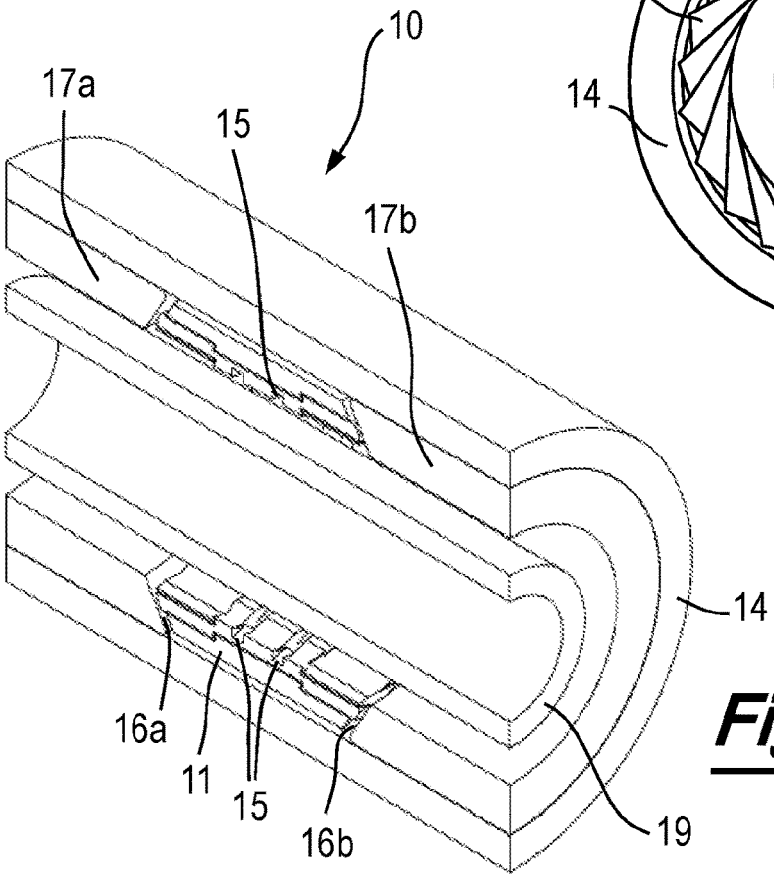
Figure 2A:
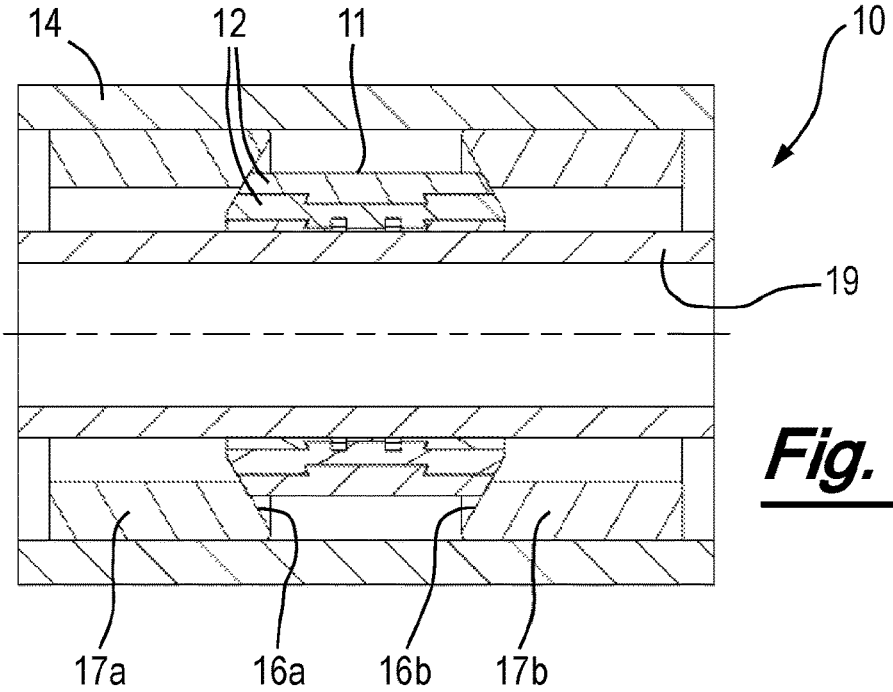
FIGS. 2A to 2C are respectively longitudinal sectional, perspective sectional and end views of the apparatus of FIGS. 1A to 1C, shown in a collapsed condition.
Figure 2C:
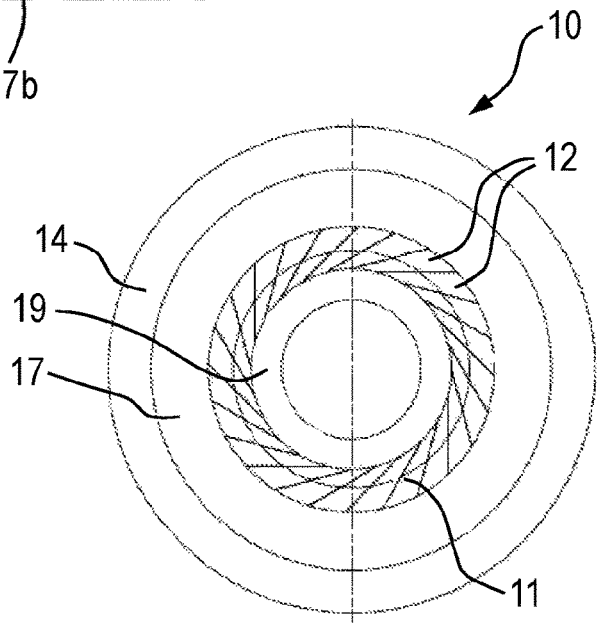
Figure 2B:
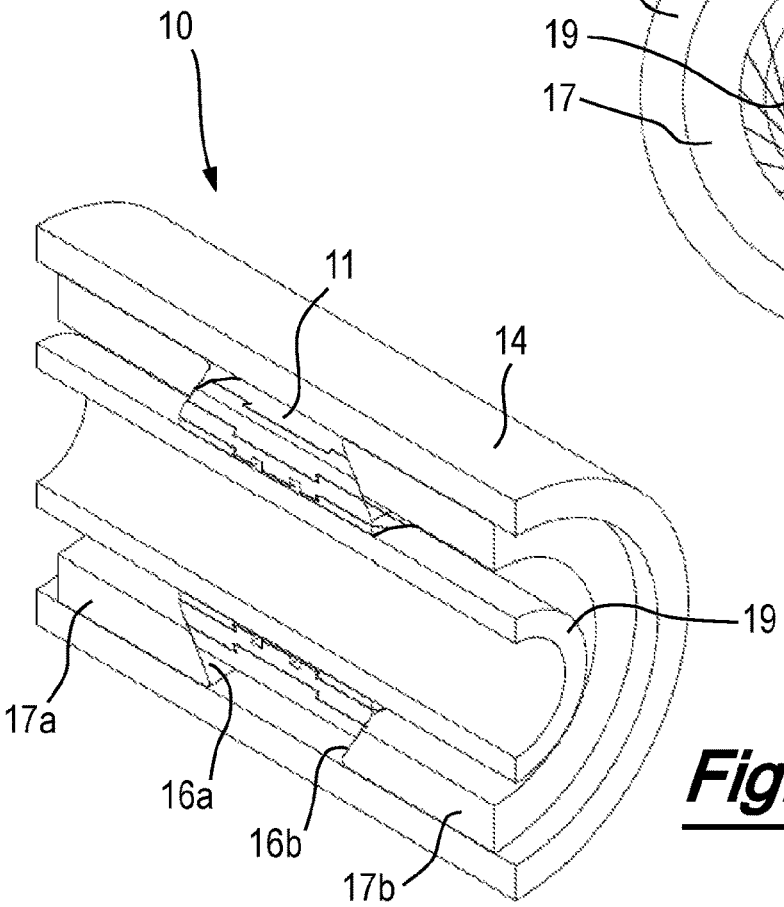

In the configuration shown in FIGS. 1 and 2, notional wedge-shaped segments are modified by removal of the tips 29 of the wedges, to provide a curved or arced inner surface 20 with radius $r_2$ when the ring is in its collapsed condition shown in FIGS. 2A and 2B. The modification of the wedge-shaped elements can be thought of as an increase in diameter of an internal bore through the ring structure by $2(r_2-r_3)$, or a truncation of the inner diameter. This change in the inner diameter from the notional inner diameter $r_3$ to which the contact surfaces are tangential to a truncated inner diameter $r_2$, has the effect of changing an angle between the contact surfaces and the radial plane from the centre of the ring. Taking angle $\theta_2$ to be the angle described between the contact surface and a radial plane defined between the centre point of the ring structure and the point at which the orientation surface meets or intersects a circle at the radial position of the inner surface, $\theta_2$ is changed in dependence on the amount by which the segment has its inner diameter truncated. For the notional wedge shaped segment, the orientation planes of the contact surfaces are tangential to a circle at the inner diameter at $r_3$ (i.e. angle $\theta_2$ is 90 degrees). For the modified elements 12, the orientation planes of the contact surfaces instead intersect a circle at the (increased) inner diameter at $r_2$ and are inclined at a reduced angle $\theta_2$.

The angle $\theta_2$ at which the segment is inclined is related to the amount of material removed from the notional wedge-shaped segment, but is independent from the central angle $\theta_1$ of the wedge. Angle $\theta_2$ is selected to provide element dimensions suitable for manufacture, robustness, and fit within the desired annular volume and inner and outer diameters of the expanded ring. As the angle $\theta_2$ approaches 90 degrees, a shallower, finer wedge profile is created by the element, which may enable optimisation of the expanded volume of the ring structure. Although a shallower, finer wedge profile may have the effect of reducing the size of the gaps created between elements in an expanded condition and/or enabling a more compact expanded condition, there are some consequences. These include the introduction of flat sections at the inner surfaces of the elements, which manifest as spaces at the inner diameter of the ring when in a collapsed or partially collapsed condition. When $\theta_2$=90 degrees, at the segments are purely tangential to inner diameter, the expanded volume for a given outer diameter and inner diameter is most efficient, but the inner surface of the ring structure is polygonal with flat sections created by each segment. These flat sections are generally undesirable in applications where the ring is designed to collapse into engagement with an internal surface. There may also be potential difficulties with manufacture of the elements and robustness of the elements and assembled ring structure. In some applications, where the profile of the inner surface of the collapsed ring is not critical, for example when the inner diameter of the ring structure is floating, and/or the true inner diameter is defined by an actuation wedge profile rather than the inner surface of the ring, this compromise may not be detrimental to the operation of the apparatus, and the reduced collapse volume may justify an inclination angle $\theta_2$ of (or approaching) 90 degrees.

In general, to provide sufficient truncation of the inner diameter to retain a useful portion of an inner arc and provide a smooth inner surface to the ring structure, a maximum useful value of $\theta_2$ is (90 degrees$-\theta_1/2$). This would be 82.5 degrees in the described arrangements. In the envisaged applications of the invention, the ring structure is desired to have a circular inner surface, and preferred arrangements may have an angle $\theta_2$ which is in the range of (90 degrees$-2\theta_1$) to (90 degrees$-\theta_1/2$). Particularly preferred arrangements have an angle $\theta_2$ in the range of 70 degrees to (90 degrees$-\theta_1/2$) (most preferably in the range of 73 degrees to (90 degrees$-\theta_1/2$)).

In the apparatus of FIGS. 1 to 4, the angle $\theta_2$ is 75 degrees. Relaxing $\theta_2$ to a reduced angle provides a smooth outer diameter and inner diameter profile to the collapsed ring, as a portion of the inner circular arc is retained at the expense of slightly increased expanded volume. It should be noted that the angle $\theta_2$ is independent from the angle $\theta_1$.

In other configurations, also in accordance with embodiments of the invention (and as will be described below) the geometry of the notional wedge-shaped segments forming the elements may be unmodified (save for the provision of functional formations such as for interlocking and/or retention of the elements), without the removal of material from the tip of the notional wedge-shaped segments. Such embodiments may be preferred when there is no requirement for the ring structure to have a circular inner surface.

As most clearly shown in FIGS. 4A to 4F, the first and second contact surfaces of the element have corresponding interlocking profiles 24 formed therein, such that adjacent elements can interlock with one another. In this case, the interlocking profiles comprise a dovetail groove 25 and a corresponding dovetail tongue 26. The interlocking profiles resist circumferential and/or radial separation of the elements in the ring structure, but permit relative sliding motion between adjacent elements. The interlocking profiles also facilitate smooth and uniform expansion and collapse of the elements during use. It will be appreciated that alternative forms of interlocking profiles, for example comprising recesses and protrusions of other shapes and forms, may be used within the scope of the invention.

The elements are also provided with inclined side wall portions 27, which may facilitate deployment of the apparatus in use. The side wall portions are formed in an inverted cone shape which corresponds to the shape and curvature of the actuating cone wedges profiles when the apparatus is in its maximum load condition (typically at its optimum collapsed condition).

Each element is provided with a pair of grooves 28, and in the assembled ring structure, the grooves are aligned to provide a circular groove which extends around the ring. The groove accommodates a biasing element 15, for example a spiral retaining ring of the type marketed by Smalley Steel Ring Company under the Spirolox brand, or a garter spring. In this case, the biasing means is located around the inner surface of the elements, to bias the apparatus towards the expanded condition shown in FIGS. 1A to 1C. Although two grooves for accommodating biasing means are provided in this embodiment, in alternative embodiments of the apparatus, a single groove or greater than two grooves and biasing means may be provided.

The apparatus 10 comprises a pair of cone wedge profiles 16*a*, 16*b*. In this case, the wedge profiles are defined by inverted cone-shaped faces on a pair of cylinders 17*a*, 17*b*, which oppose the ring structure 11. The wedge profiles are moveable relative to one another on experiencing an axial force. The angle of the wedge profiles corresponds with the angle of the inclined side walls 27 of the elements 12

Operation of the expansion apparatus will now be described. In the first expanded condition, shown most clearly in FIG. 1B, the elements are assembled in a ring structure 11 which has a first inner diameter. In this embodiment, and as shown in FIGS. 1B and 1C, the cylinders 17*a*, 17*b* define the inner diameter of the apparatus in the first condition. The elements 12 are biased towards the expanded condition by a circumferential spring 15, and are supported on their outer surface by the inner surface of the cylinder 14.

In use, an axial actuation force is imparted between the cylinders 17*a*, 17*b* to bring them together. Any of a number of suitable means known in the art can be used for application of the axial actuation force, for example, the application of a force from a sleeve positioned in contact with one of the cylinders 17*a*, 17*b*. The force causes the wedge profiles 16*a*, 16*b* to move axially with respect to one another, and transfer a component of the axial force onto the recessed side wall 27 of the elements 12. The angle of the wedge transfers a radial force component to the elements 12, which causes them to slide with respect to one another along their respective contact surfaces 22, 23.

The movement of the collapsing elements is tangential to a circle defined around the longitudinal axis of the apparatus. The contact surfaces of the elements mutually support one another before, during, and after expansion. The radial position of the elements moves closer to the longitudinal axis of the apparatus on continued application of the axial actuation force until the elements are located at a desired inner radial position. This radial position may be defined by a controlled and limited axial displacement of the wedge profiles 16*a*, 16*b*, or alternatively can be determined by the inner surface of the tubular 19 in which the apparatus is disposed.

FIGS. 2A to 2C show the apparatus in its collapsed condition. At an optimal collapsed condition, shown most clearly in FIG. 2C, the inner surfaces of the individual elements 12 combine to form a complete circle with no gaps in between the individual elements. The inner surface of the collapsing apparatus can be optimised for a specific diameter of internal tubular 19, to form a perfectly round collapsed ring (within manufacturing tolerances) with no extrusion gaps on the inner or outer surfaces of the ring structure. The design of the expansion apparatus also has the benefit that a degree of under travel or over travel (for example, to a slightly different radial position) does not introduce significantly large gaps.

It is a feature of the invention that the elements are mutually supported before, throughout, and after the collapsing of the ring structure, and do not create gaps between the individual elements during collapsing or at the fully collapsed position. In addition, the arrangement of elements in a circumferential ring, and their movement in a plane perpendicular to the longitudinal axis, facilitates the provision of smooth side faces or flanks on the ring structure. With deployment of the elements taking place in the plane of the ring structure, the width of the ring structure does not change. This enables use of the apparatus in close axial proximity to other functional elements.

The apparatus has a range of applications, some of which are illustrated in the following example embodiments. However, additional applications of the apparatus are possible, which may exploit its ability to effectively perform one or more of: blocking or sealing an annular path; contacting an outer surface of an internal tubular; gripping or anchoring against internal surface; locating or engaging with a radially spaced profile; and/or supporting a radially spaced internal component.

There will now be described, with reference to FIGS. 5A to 6C, an application of the expansion apparatus of the invention to a latching arrangement, and in particular a so-called "quick connect" mechanism used for latched connection of tubular components.

Figure 5A:
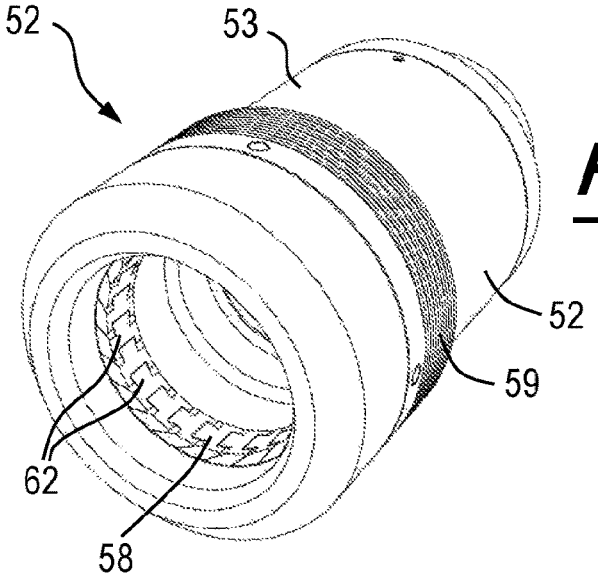
FIGS. 5A to 5D are respectively perspective, perspective cut away, sectional and cross sectional views of a connection system according to an embodiment of the invention, shown in a latched position.
Figure 5B:
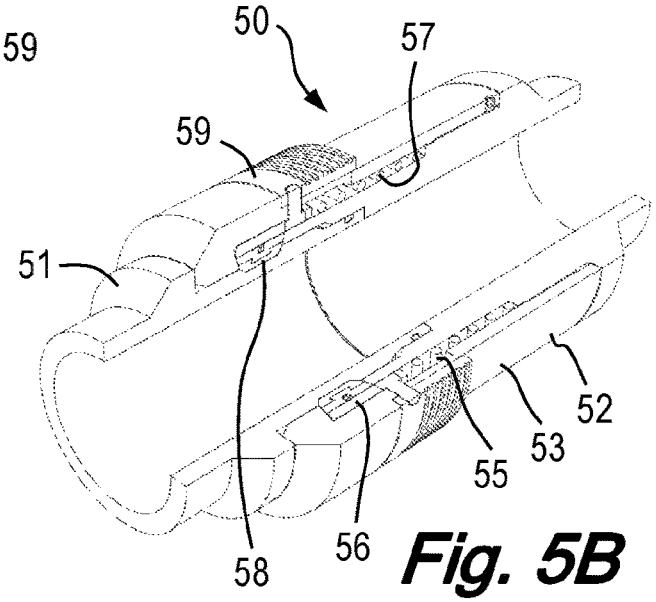
Figure 5D:
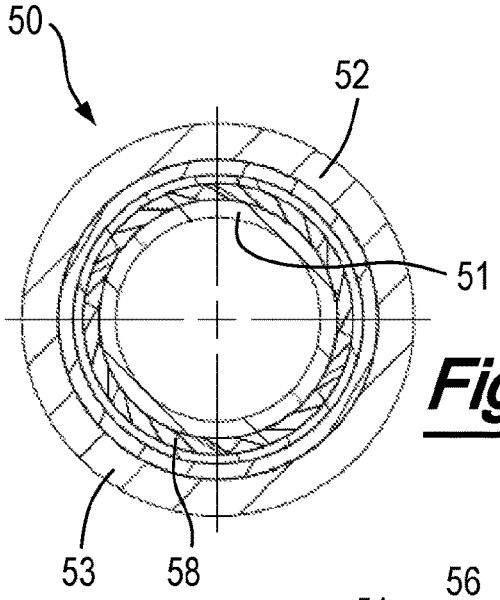
Figure 5C:
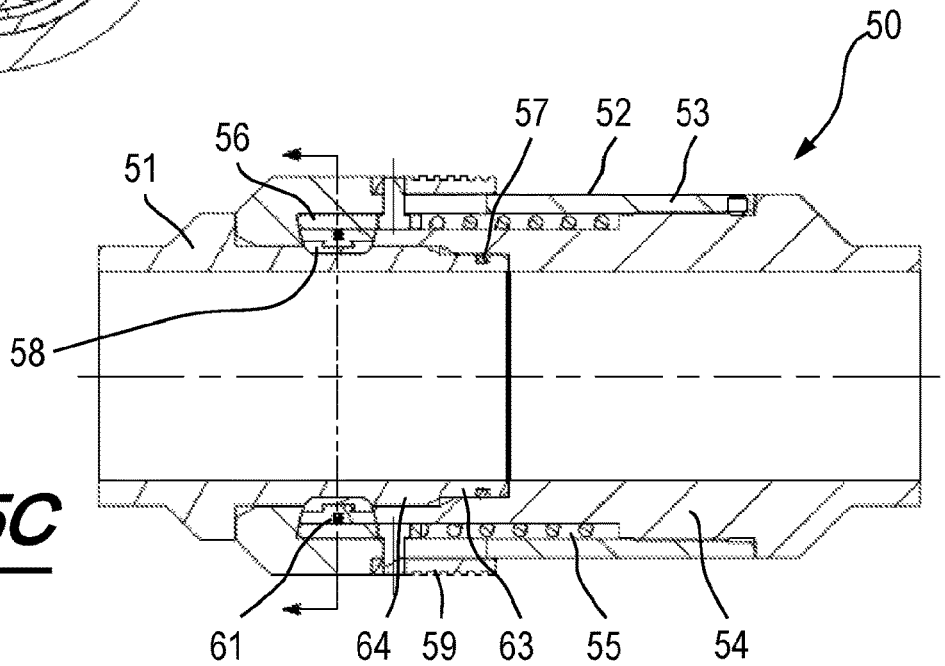
Figure 6A:
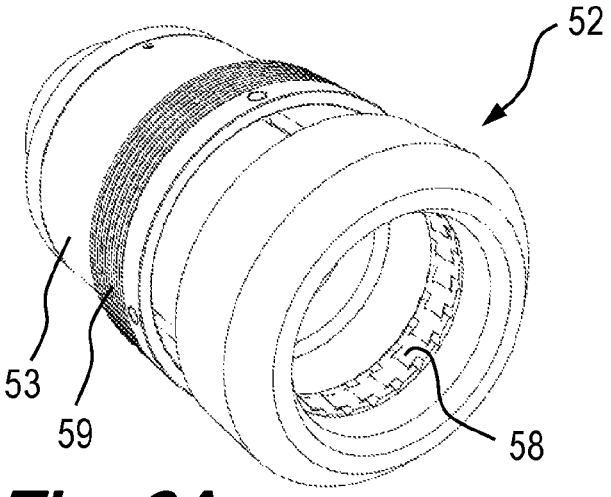
FIGS. 6A to 6C are respectively perspective, sectional and cross-sectional views of the connection system of FIGS. 5A to 5D.
Figure 6C:
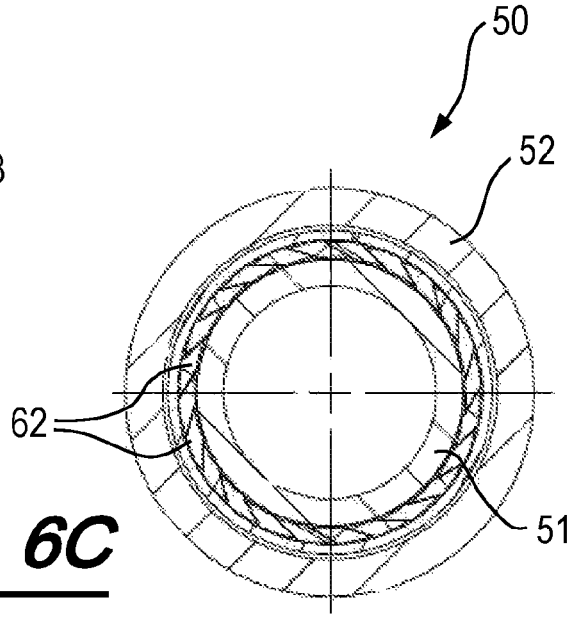
Figure 6B:
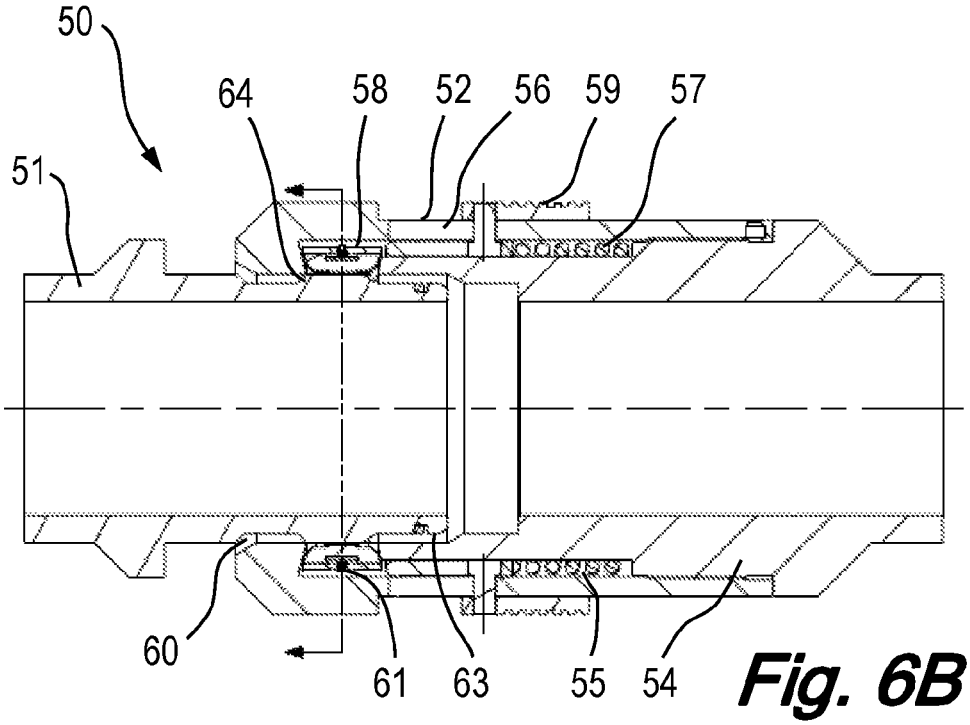

The connection system, generally shown at 50, comprises a male connector 51 and a female connector 52. FIG. 5A is an isometric view of the female connector 52 according to an embodiment of the invention, and FIG. 5B to 5D are respectively partially cut away isometric, longitudinal section and cross sectional views of an assembled pair of the male connector 51 and a female connector 52. All of FIGS. 5A to 5D show the apparatus in a collapsed condition. FIGS. 6A to 6C are equivalent views which show the connection system in an expanded release condition.

The female connector 52 comprises an outer housing 53 disposed over an inner mandrel 54 which defines a throughbore through the connector. The female connector 52 comprises a throughbore, which is continuous with the throughbore of the inner mandrel. A first end of the inner mandrel is sized to fit into an opening in the female connector.

The outer housing 53 partially surrounds the mandrel 54. Over a portion of its length, the housing 53 has a throughbore formed to an inner diameter larger than the outer diameter of the mandrel 54, such that an annular space 55 is formed between the inner mandrel and the outer housing when the two are assembled together. The annular space between the outer housing 53 and the inner mandrel 54 accommodates a support sleeve 56 and a biasing means in the form of a coil spring 57. The spring 57 functions to bias the support sleeve 56 to a position in which it is disposed over a collapsing apparatus 58 which forms a latching ring for the connection system. An outer surface of the collapsing apparatus is supported on the inner surface of the support sleeve 56. The support sleeve is also mechanically coupled to an external sleeve 59, disposed on the outside of the outer housing by pins extending through axially oriented slots in the outer housing.

The outermost end of the male connector has a reduced outer diameter portion 63 which is sized to fit within the inner diameter of the collapsing apparatus 58 in its collapsed condition. The male connector 51 also comprises an annular recess 60 which is sized and shaped to receive the collapsing apparatus in a latched position. The annular recess is profiled with chamfered edges, to correspond to the inclined surfaces at the outside of the collapsing apparatus 58. A raised annular lip 64, at the principal outer diameter of the male connector, separates the recess 60 from the reduced outer diameter portion 63.

The collapsing apparatus 58 of this embodiment of the invention is similar to the collapsing apparatus 10, and its form and function will be understood described from FIGS. 1 to 4 and the accompanying description. The apparatus 58 is assembled from multiple elements 62 to form a ring structure. However, a significant difference is that the apparatus 58 is biased towards a collapsed condition to provide a latching ring for the connection system. This is achieved by the provision of grooves on the outer surfaces of the elements 62 which make up the ring structure, to accommodate a circumferential spring element 61. The circumferential spring element 61 retains the elements of the ring structure in their radially collapsed position, and in an optimum concentric state during expansion.

The profile of the elements is such that they are wider at their outer surface than their inner surface, and wider than the tapered groove through which the ring structure extends. This prevents the elements of the ring structure from being pushed into the bore of the female connector by the circumferential spring element when the system is disconnected.

Disconnection of the connection system 50 will now be described, with additional reference to FIGS. 6A to 6C. FIGS. 5A to 5D show the default, normally collapsed position of the connector system 50 and its collapsing apparatus 58. The circumferential spring element of the collapsing apparatus biases the elements inward into the position shown at FIG. 5A, and they are radially supported in that position by the support sleeve 56. The external sleeve 59 allows the support sleeve 56 to be retracted against the biasing force of the spring 57. Withdrawal of the support sleeve 56 from the outside of the collapsing apparatus 58 enables the ring to be expanded to its raised radial position, shown in FIGS. 6A to 6C. The presence of the circumferential spring element 61 retains the elements in an inward collapsed condition, but with the support sleeve 56 retracted, an axial force which acts to separate the male and female parts of the connector will impart an axial force on the elements of the ring structure, via the chamfered edges of the recess 60. The profile of the recess and the elements directs a radial force component which tends to cause the elements to expand against the force of the circumferential spring element. The elements are expanded to a raised diameter position which allows the male and female connectors to be separated. When the collapsing apparatus is clear of the female connector, the force of the spring element will tend to collapse the elements back to their radially collapsed positions. Releasing the external sleeve will position the support sleeve around the ring structure to support it in the collapsed condition.

To connect the connectors of the connection system, the external sleeve is retracted to withdraw the support sleeve from its position around the elements 62. An axial force which directs the male connector into the female connector causes the ring structure to be brought into abutment with a chamfered shoulder between the reduced outer diameter portion 63 and the raised annular lip 64. The inclined surface of the elements 62 causes them to be radially expanded against the force of the circumferential spring element, until the annular lip 64 is able to travel into the female connector 52 to the latching position. When the ring structure is aligned with the recess 60, the circumferential spring element pushes the elements to collapse them into the recess. Release of the external sleeve positions the support sleeve around the ring structure and the connector is latched.

In its latched position and when in operation, a raised internal pressure in the throughbore of the connection system acts to radially compress and clamp the male connector, the ring structure, and the support sleeve together. This resists or prevents retraction of the external sleeve and support sleeve, maintaining the connection in a failsafe latched condition.

A significant advantage of the connection system of this embodiment of the invention is that the expansion apparatus forms a solid and smooth ring in its collapsed latched position, and when in its expanded release position, the elements 62 remain in contact with one another with no substantial gaps between the elements 62, as shown in FIG. 6C. An arrangement of radially split elements would, when expanded, form a ring with spaces between elements around the sides. By minimising or eliminating gaps between elements, the device is less prone to ingress of foreign matter which could impede the collapsing action of the mechanism. In addition, the provision of a continuous engagement surface which surrounds the ring structure and provides full annular contact with the recess provides a latch capable of supporting large axial forces, and therefore the connection system can be rated to a higher maximum working pressure.

The principles of the connection system of this embodiment may also be applied to subsea connectors such as tie-back connectors. In alternative embodiments, the external sleeve for retracting the support sleeve may be hydraulically actuated, rather than manually as shown in the described embodiments.

It will be apparent from the description that the collapsing apparatus described with reference to FIGS. 1 to 4 may be applied to tools and devices other than connector systems. For example, the apparatus may provide support or back-up for any suitable flow barrier or seal element in a fluid conduit, which may function to improve the integrity of the fluid barrier or seal, and/or enable a reduction in the axial length of the seal element or flow barrier without compromising its functionality. The seal element or flow barrier may be mounted externally to the sealing surface, or the system may be used to provide an anti-extrusion ring or back-up ring for an internally disposed compressible, inflatable and/or swellable packer systems.

Alternatively or in addition, the apparatus may be used to anchor any of a wide range of tools in a wellbore, by providing the inner surfaces of the element with engaging means to provide anchoring forces which resist movement in upward and/or downward directions. The elements may therefore be configured as externally mounted slips, which are brought into contact with an internal surface.

The invention may also be applied to downhole locking of wellbore components, including the locking of downhole components and hanging or suspending of components such as tubulars at or above the wellhead. A typical locking tool uses one or more radially expanding components deployed on a running tool. The radially expanding components engage with a pre-formed locking profile at a known location in the wellbore completion. A typical locking profile and locking mechanism includes a recess for mechanical engagement by the radially expanding components of the locking tool. A seal bore is typically provided in the profile, and a seal on the locking tool is designed to seal against the seal bore. The present embodiment of the invention provides benefits over conventional locking mechanism, including providing an integrated seal element between two collapsing ring structures, which does not require a separate seal assembly at an axially separated location. An integrated seal may be surrounded at its upper and lower edges by the surfaces of the ring structures, which mitigate or avoid extrusion of the seal.

In addition, each of the ring structures is capable of providing a smooth, unbroken circumferential surface which engages an internal locking recess, providing upper and lower annular surfaces in a plane perpendicular to the longitudinal axis of the bore. This annular surface is smooth and unbroken around the circumference of the ring structures, and therefore the lock is in full abutment with upper and lower shoulders defined in the locking profile. This is in contrast with conventional locking mechanisms which may only have contact with a locking profile at a number of discrete, circumferentially-separated locations around the device. The increased surface contact enables a locking mechanism which can support larger axial forces being directed through the lock. Alternatively, an equivalent axial support can be provided in a lock which has reduced size and/or mass.

Another advantage of this embodiment of the invention is that a seal surface (i.e. the part of the internal surface with which a seal element on the collapsing apparatus creates a seal) can be recessed in the locking profile. The benefit of this configuration is that the seal surface is protected during running of the equipment through the wellbore, avoiding impacts which would tend to damage the seal bore, reducing the likelihood of reliably and repeatedly creating a successful seal.

In alternative embodiments (not illustrated), a collapsing ring structure can be used to provide a flow barrier or fluid seal, directly, rather than supporting or backing-up a separate seal element. To facilitate this, the elements which are assembled together to create the ring structures may be formed from a metal or metal alloy which is coated or covered with a polymeric, elastomeric or rubber material. An example of such a material is silicone polymer coating. All surfaces of the elements may be coated, for example by a dipping or spraying process, and the mutually supportive arrangement of the elements keeps them in compression in their operating condition. This enables the ring structures themselves to function as flow barriers, and in some applications, a fluid seal may be created which is sufficient to hold a differential pressure. Alternatively, or in addition, the elements themselves may be formed from a compressible and/or resilient material, such as an elastomer, rubber or polymer.

Applications to the oil and gas industry include downhole applications, but also include surface and/or subsea applications to drilling and well control systems. An example application to a drilling blowout preventer (BOP) will now be described with reference to FIGS. 7A and 7B.

Figure 7B:
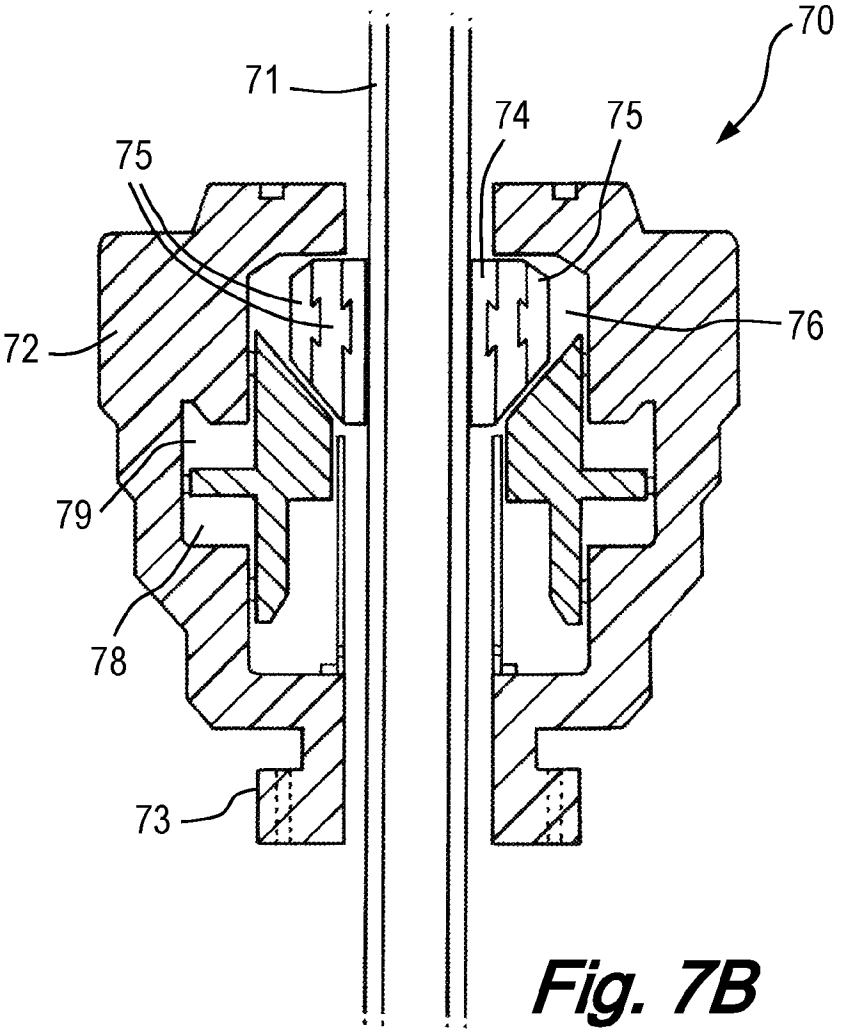
FIGS. 7A and 7B are respectively schematic views of an apparatus according to an embodiment of the invention applied to an annular blow-out preventer in open and closed conditions.
Figure 7A:
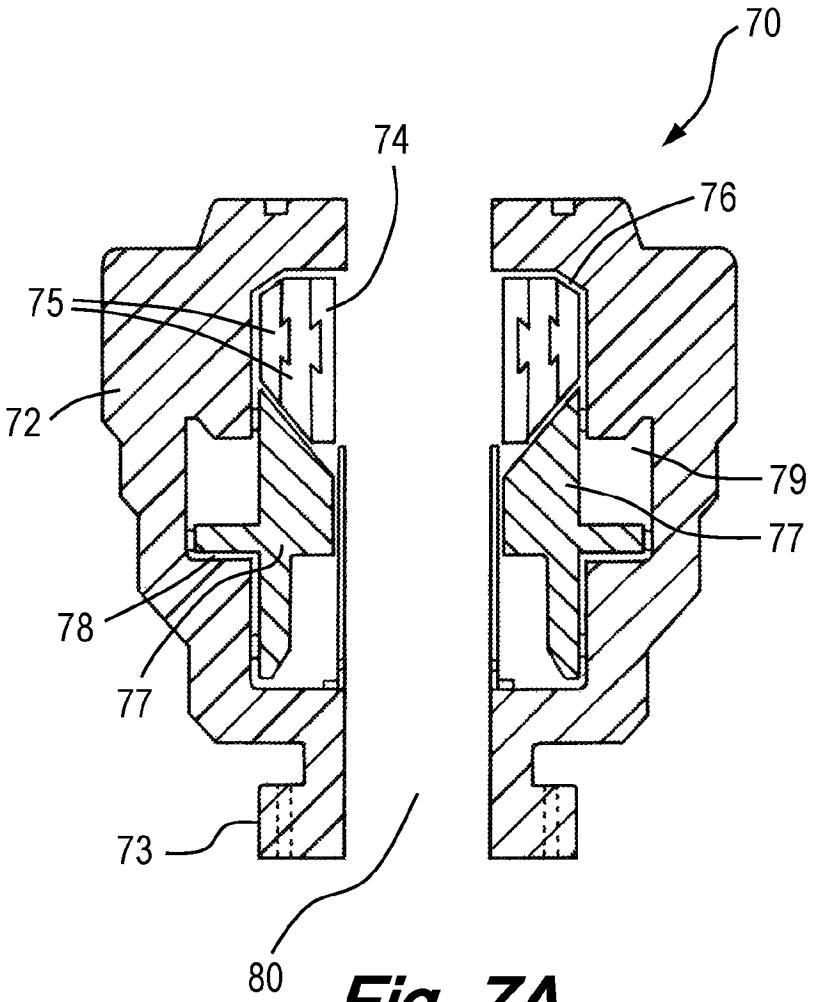

FIG. 7A is a schematic longitudinal section through an annular blowout preventer, generally depicted at 70, in an open condition, and FIG. 7B is a schematic longitudinal section of the annular blow-out preventer 70 in a closed condition around a drill pipe 71.

The blowout preventer, generally depicted at 70, comprises a housing 72 configured to be coupled into a well control package on a wellhead via a flange connector 73. The BOP may be located directly on a wellhead, or may be located on top of other well control apparatus, for example as part of a BOP stack. The BOP defines a throughbore which is continuous with a drilling riser throughbore (not shown), and is large enough to permit the passage of drilling equipment, including drillpipe 71, drilling collars and drill bits.

The BOP 70 defines an internal volume 76 which accommodates functional elements of the BOP to create a seal with an internal tubular such as a drill pipe 71. The BOP comprises a collapsing apparatus in the form of a ring structure assembled from a plurality of elements 75. The ring structure 74 is similar to the ring structure 11, and its form and function will be understood from FIGS. 1 to 4.

The BOP also comprises a piston 77, shown in FIG. 7A in its retracted, open position. The piston 77 comprises an inverted, conical wedge portion at its upper end, which opposes a profiled surface of the collapsing ring structure 74. The piston 77 includes lower and upper seal rings, and an annular flange which defines functional piston faces. A seal ring around the annular extending flange seals the piston against the inner surface of the recess, and defines a lower opening chamber 78 and an upper closing chamber 79. The upper and lower piston chambers 78, 79 are connected to a source of hydraulic pressure via hydraulic lines (not shown).

In use, the piston 77 is operable to be actuated to an extended, closed position, by increasing the hydraulic pressure in the lower chamber 78 relative to the chamber 79, causing the piston to travel in an upward direction and impart an axial force on the elements of the ring structure 74. The ring structure 74, by the action of a radial force component through the wedge and contact surface, is collapsed to a reduced inner diameter position, shown in FIG. 7B. The collapsing ring contacts and seals against the surface of the drill pipe 71. The collapsing ring structure is optimised to provide a smooth circular surface to the surface of the drill pipe. In this embodiment, the elements of the collapsing ring structure are formed from a conformable material, which is capable of being compressed sufficiently to create a seal in the annular space 76 between the drill pipe and the housing 72.

In a further alternative embodiment of the invention (not illustrated) the characteristics of the collapsing apparatus are exploited to provide a substrate which supports a collapsible or deformable element arranged internally to the ring structure. As described above, the collapsed ring structures of embodiments of the invention provide a smooth circular cylindrical surface at their optimum collapsed conditions. This facilitates use of the apparatus as an endo-skeleton to provide structural support for components such as sheaths, tubulars, expanding sleeves, locking formations and other components in fluid conduits or wellbores.

Additional applications of the invention include using the collapsing structure to create an inwardly expanding seat for landing a tool or other object in a downhole location. The seat may be in a normally expanded condition so that it is clear of the wellbore, providing full bore access to the wellbore below the apparatus. Actuation of the apparatus collapses a ring structure to create an annular restriction in the bore, on which tools or equipment may be landed, or to provide a no-go profile for a particular intervention operation.

The apparatus may also be used to control the flow of fluids in a wellbore or a wellbore annulus. A ring structure may be fully or partially collapsed from an open expanded condition to reduce the flow area in a wellbore or wellbore annulus. By varying the collapse/expansion condition of the ring structure, the apparatus can be used to create a variable flow area, and therefore provide variable choke control for fluids flowing in the wellbore or wellbore annulus.

The invention provides an expanding and collapsing ring apparatus and method of use. The expanding and collapsing ring comprises a plurality of elements assembled together to form a ring structure oriented in a plane around a longitudinal axis. The ring structure defines an inner ring surface configured to be presented to a surface of an object arranged internally to the ring structure. The ring structure is operable to be moved between a collapsed condition and a first expanded condition by movement of the plurality of elements on actuation by an axial force. The plurality of elements is operable to be moved between the expanded and collapsed conditions by sliding with respect to one another in the plane of the ring structure. Applications of the invention include oilfield devices, connection systems, flow barriers and packers.

The invention in its various forms benefits from the novel structure and mechanism of the apparatus.

In addition, the outer surfaces of the individual elements combine to form a complete circle with no gaps in between the individual elements, and therefore the apparatus can be optimised for a specific diameter, to form a perfectly round collapsed ring (within manufacturing tolerances) with no extrusion gaps on the inner or outer surfaces of the ring structure. The design of the expansion apparatus also has the benefit that a degree of under expansion or over expansion (for example, to a slightly different radial position) does not introduce significantly large gaps.

It is a feature of the invention that the elements are mutually supported before, throughout, and after collapsing, and do not create gaps between the individual elements during collapsing or at the fully collapsed position. In addition, the arrangement of elements in a circumferential ring, and their movement in a plane perpendicular to the longitudinal axis, facilitates the provision of smooth side faces or flanks on the ring structure. With deployment of the elements in the plane of the ring structure, the width of the ring structure does not change. This enables use of the apparatus in close axial proximity to other functional elements.

In addition, each of the ring structures provides a smooth, unbroken circumferential surface which may be used in engagement or anchoring applications, including in plugs, locks, and connectors. This may provide an increased anchoring force, or full abutment with upper and lower shoulders defined in a locking or latching profile, enabling tools or equipment be rated to a higher maximum working pressure.

Various modifications to the above-described embodiments may be made within the scope of the invention, and the invention extends to combinations of features other than those expressly claimed herein. In particular, the different embodiments described herein may be used in combination, and the features of a particular embodiment may be used in applications other than those specifically described in relation to that embodiment.

The invention claimed is:

1. An apparatus comprising:

a plurality of elements assembled together to form a ring structure oriented in a plane around a longitudinal axis;

wherein the ring structure defines an inner ring surface configured to be presented to a surface of an object arranged internally to the ring structure;

wherein the ring structure is operable to be moved between an expanded condition and a collapsed condition by movement of the plurality of elements on actuation by an axial force;

wherein the plurality of elements is operable to be moved between the expanded and collapsed conditions by sliding with respect to one another in the plane of the ring structure;

wherein the elements are provided with interlocking profiles for interlocking with an adjacent element in both the expanded and collapsed conditions.

2. The apparatus according to claim 1, wherein the inner ring surface is a substantially cylindrical surface arranged to contact or otherwise interact with an outer surface of a tubular or cylinder.

3. The apparatus according to claim 2, wherein the inner ring surface is substantially smooth.

4. The apparatus according to claim 2, wherein the inner ring surface is provided with one or more functional formations thereon, for interacting with the surface of an object arranged internally to the ring structure.

5. The apparatus according to claim 1, wherein the elements are configured to move between their expanded and collapsed radial positions in a path which is tangential to a circle described around and concentric with the longitudinal axis.

6. The apparatus according to claim 1, wherein each element of the ring structure comprises a first contact surface and second contact surface respectively in abutment with first and second adjacent elements, and wherein the elements are configured to slide relative to one another along their respective contact surfaces.

7. The apparatus according to claim 6, wherein the first contact surface and/or the second contact surface are oriented tangentially to a circle described around and concentric with the longitudinal axis.

8. The apparatus according to claim 6, wherein the first contact surface and the second contact surface converge towards one another in a direction towards an inner surface of the ring structure.

9. The apparatus according to claim 6, wherein the first and second contact surfaces of an element are oriented on first and second planes, which intersect an inner surface of the ring at first and second intersection lines, such that a sector of an imaginary cylinder is defined between the longitudinal axis and the intersection lines; and wherein a central angle of the sector is in the range of 10 degrees to 20 degrees.

10. The apparatus according to claim 9, wherein the central angle of the sector is 15 degrees, corresponding to twenty-four elements assembled together to form the ring structure.

11. The apparatus according to claim 1, wherein the apparatus comprises a support surface for the ring structure, wherein the support surface is an inner surface of a mandrel or tubular and supports the ring structure in an expanded condition of the apparatus.

12. The apparatus according to claim 1, wherein an operating condition of the apparatus is its collapsed condition, wherein the ring structure is a substantially solid ring structure in the collapsed condition, and wherein the elements are fully mutually supported in the collapsed condition.

13. The apparatus according to claim 1, comprising a formation configured to impart a radial expanding or collapsing force component to the elements of the ring structure from an axial actuation force.

14. The apparatus according to claim 13, wherein the formation comprises a wedge or wedge profile.

15. The apparatus according to claim 1, comprising a biasing means configured to bias the ring structure to one of its expanded or collapsed conditions.

16. The apparatus according to claim 15, wherein the biasing means comprises a circumferential spring, a garter spring, or a spiral retaining ring.

17. The apparatus according to claim 15, wherein the biasing means is arranged around an outer surface of the ring structure, to bias it towards a collapsed condition.

18. The apparatus according to claim 15, wherein the biasing means is arranged around an inner surface of the ring structure, to bias it towards an expanded condition.

19. An oilfield tool comprising the apparatus of claim 1.

20. The oilfield tool according to claim 19, configured as a wellhead tool.

21. A connector system comprising a first connector and a second connector, wherein one of the first and second connectors comprises the apparatus of claim 1.

22. A method of expanding an apparatus, the method comprising:

providing an apparatus comprising a plurality of elements assembled together to form a ring structure oriented in a plane around a longitudinal axis; and imparting or releasing an axial force to the ring structure to move the plurality of elements by sliding with respect to one another in the plane of the ring structure, thereby moving the ring structure from a collapsed condition to an expanded condition;

wherein the elements are provided with interlocking profiles for interlocking with an adjacent element in both the expanded and collapsed conditions.

23. A method of collapsing an apparatus, the method comprising:

providing an apparatus comprising a plurality of elements assembled together to form a ring structure oriented in a plane around a longitudinal axis; and imparting or releasing an axial force to the ring structure to move the plurality of elements by sliding with respect to one another in the plane of the ring structure, thereby moving the ring structure from an expanded condition to a collapsed conditions;

wherein the elements are provided with interlocking profiles for interlocking with an adjacent element in both the expanded and collapsed conditions.

* * * * *